US009957830B2

(12) United States Patent
McCaffrey et al.

(10) Patent No.: US 9,957,830 B2
(45) Date of Patent: May 1, 2018

(54) HYBRID PASSIVE AND ACTIVE TIP CLEARANCE SYSTEM

(71) Applicant: UNITED TECHNOLOGIES CORPORATION, Hartford, CT (US)

(72) Inventors: Michael G. McCaffrey, Windsor, CT (US); Mark Borja, Palm Beach Gardens, FL (US); Brandon T. Rouse, Anacortes, WA (US); John R. Farris, Bolton, CT (US); Brian R. Pelletier, Berwick, ME (US); Thomas Almy, Rocky Hill, CT (US); Igor S. Garcia, Salem, CT (US)

(73) Assignee: United Technologies Corporation, Farmington, CT (US)

( * ) Notice: Subject to any disclaimer, the term of this patent is extended or adjusted under 35 U.S.C. 154(b) by 292 days.

(21) Appl. No.: 14/765,117

(22) PCT Filed: Mar. 5, 2014

(86) PCT No.: PCT/US2014/020468
§ 371 (c)(1),
(2) Date: Jul. 31, 2015

(87) PCT Pub. No.: WO2014/189590
PCT Pub. Date: Nov. 27, 2014

(65) Prior Publication Data

US 2015/0369076 A1 Dec. 24, 2015

Related U.S. Application Data

(60) Provisional application No. 61/774,055, filed on Mar. 7, 2013.

(51) Int. Cl.
*F01D 11/18* (2006.01)
*F01D 11/22* (2006.01)
(Continued)

(52) U.S. Cl.
CPC ..... *F01D 11/18* (2013.01); *F01D 5/02* (2013.01); *F01D 11/22* (2013.01); *F01D 11/24* (2013.01);
(Continued)

(58) Field of Classification Search
CPC ..... F01D 11/18; F01D 5/02; F05D 2270/52; F05D 2270/62; F05D 2270/55; F05D 2270/32
See application file for complete search history.

(56) References Cited

U.S. PATENT DOCUMENTS 2,994,472 A * 8/1961 Botje ..... F01D 11/24 415/113
4,482,293 A * 11/1984 Perry ..... F01D 11/24 415/113
(Continued)

FOREIGN PATENT DOCUMENTS

FR 2890685 A1 * 3/2007 ..... F01D 11/24
FR 2933131 A1 * 1/2010 ..... F01D 19/02

OTHER PUBLICATIONS

International Preliminary Report on Patentability for International Application No. PCT/US2014/020468 dated Sep. 17, 2015.
(Continued)

*Primary Examiner* — Patrick Maines
(74) *Attorney, Agent, or Firm* — Carlson, Gaskey & Olds, P.C.

(57) ABSTRACT

A control ring extends circumferentially about a central axis. A plurality of circumferentially spaced carrier portions have a cavity receiving the control ring. There are circumferential gaps between the carrier portions. A blade outer air seal is mounted on the carrier portions radially inwardly of the
(Continued)

control ring. The control ring maintains the carrier portions at a radially outwardly expanded position when heated by an electric heater.

17 Claims, 3 Drawing Sheets

(51) Int. Cl.
*F01D 11/24* (2006.01)
*F01D 5/02* (2006.01)
*F01D 25/24* (2006.01)

(52) U.S. Cl.
CPC ..... *F01D 25/24* (2013.01); *F05D 2220/32* (2013.01); *F05D 2240/55* (2013.01); *F05D 2270/52* (2013.01); *F05D 2270/62* (2013.01)

(56) References Cited

U.S. PATENT DOCUMENTS

| | | | | |
|---|---|---|---|---|
| 5,056,988 | A | 10/1991 | Corsmeier et al. | |
| 5,545,007 | A | 8/1996 | Martin | |
| 7,663,264 | B2 | 2/2010 | Dubois et al. | |
| 2008/0267770 | A1 | 10/2008 | Webster et al. | |
| 2009/0010758 | A1* | 1/2009 | Wunderlich | F01D 11/08 415/214.1 |
| 2009/0037035 | A1* | 2/2009 | Hershey | F01D 11/24 701/3 |
| 2011/0229306 | A1 | 9/2011 | Lewis et al. | |
| 2012/0063884 | A1 | 3/2012 | Klingels | |
| 2012/0126584 | A1 | 7/2012 | Philippot | |
| 2012/0167584 | A1* | 7/2012 | Philippot | F01D 11/24 60/778 |
| 2014/0193237 | A1* | 7/2014 | Reiter | F01D 11/24 415/1 |
| 2014/0230441 | A1* | 8/2014 | Mayer | F02C 7/12 60/730 |

OTHER PUBLICATIONS

Supplementary European Search Report for European Application No. 14801010.1 dated Nov. 22, 2016.

International Search Report and Written Opinion for PCT Application No. PCT/US2014020468, dated Dec. 24, 2014.

* cited by examiner

HYBRID PASSIVE AND ACTIVE TIP CLEARANCE SYSTEM

CROSS-REFERENCE TO RELATED APPLICATION

This application claims priority to U.S. Provisional Application No. 61/774,055, filed Mar. 7, 2013.

STATEMENT REGARDING FEDERALLY SPONSORED RESEARCH OR DEVELOPMENT

This invention was made with government support under Contract No. N00019-12-D-0002 awarded by the United States Navy. The Government has certain rights in this invention.

BACKGROUND

This application relates to a mount for a blade outer air seal in a gas turbine engine.

Gas turbine engines typically include a fan delivering air into a compressor. The air is compressed in the compressor and delivered into a combustion section where it is mixed with fuel and ignited. Products of this combustion pass downstream over turbine blades, driving them to rotate. Turbine rotors, in turn, drive the compressor and fan rotors.

The efficiency of the engine is impacted by ensuring that the products of combustion pass in as high a percentage as possible across the turbine blades. Leakage around the blades reduces efficiency.

Thus, a blade outer air seal is provided radially outward of the blades to prevent leakage radially outwardly of the blades. The blade outer air seal is spaced from a radially outer part of the blade by a tip clearance.

Since the blades and the blade outer air seal are formed of different materials, they respond to temperature changes in different manners. As the two expand while being heated, the tip clearance may be reduced and the blade may rub on the blade air outer seal, which is undesirable.

SUMMARY

In a featured embodiment, a blade outer air seal assembly has a control ring extending circumferentially about a central axis. A plurality of circumferentially spaced carrier portions has a cavity receiving the control ring. The carrier portions are positioned with circumferential gaps between the carrier portions. A blade outer air seal is mounted on the carrier portions radially inwardly of the control ring. The control ring maintains the carrier portions at a radially outwardly expanded position when the control ring is heated by an electric heater.

In another embodiment according to the previous embodiment, power is selectively provided to the heater responsive to a control signal.

In another embodiment according to any of the previous embodiments, the control signal is provided by an engine control system.

In another embodiment according to any of the previous embodiments, the control signal is provided responsive to receiving a temperature of the control ring.

In another embodiment according to any of the previous embodiments, the control signal is provided with feedback from the engine by engine sensors.

In another embodiment according to any of the previous embodiments, the control signal is provided responsive to a virtual flight model.

In another embodiment according to any of the previous embodiments, the control signal causes power to be provided to the heater based on determining that the carrier portions should be maintained at the radially outwardly expanded position.

In another embodiment according to any of the previous embodiments, the heater is powered when an engine control system predicts aggressive military maneuvering of an aircraft.

In another embodiment according to any of the previous embodiments, the heater is turned off responsive to determining that more efficient operation is required.

In another embodiment according to any of the previous embodiments, the blade outer seal is installed in a turbine section.

In another embodiment according to any of the previous embodiments, the electric heater is part of the control ring.

In another featured embodiment, a gas turbine engine has a turbine section having a plurality of rotating turbine blades, and a blade outer air seal mounted radially outwardly of the turbine section. There is a tip clearance between a radially outer portion of the blades and a radially inner face of the blade outer air seal. A control ring extends circumferentially about a central axis. A plurality of circumferentially spaced carrier portions have a cavity receiving the control ring. The carrier portions are positioned with circumferential gaps between the carrier portions. The blade outer air seal is mounted on the carrier portions radially inwardly of the control ring. The control ring maintains the carrier portions at a radially outwardly expanded position when the control ring is heated by an electric heater.

In another embodiment according to any of the previous embodiments, power is selectively provided to the heater responsive to a control signal.

In another embodiment according to any of the previous embodiments, the control signal is provided by an engine control system.

In another embodiment according to any of the previous embodiments, the control signal is provided responsive to receiving a temperature of the control ring.

In another embodiment according to any of the previous embodiments, the control signal is provided with feedback from the engine by engine sensors.

In another embodiment according to any of the previous embodiments, the control signal is provided responsive to a virtual flight model.

In another embodiment according to any of the previous embodiments, the control signal causes power to be provided to the heater based on determining the carrier portions should be maintained at the radially outwardly expanded position.

In another embodiment according to any of the previous embodiments, the heater is powered when an engine control system predicts aggressive military maneuvering of an aircraft.

In another embodiment according to any of the previous embodiments, the heater is turned off responsive to determining that more efficient operation is required.

In another embodiment according to any of the previous embodiments, the control signal is provided responsive to receiving a temperature of the control ring.

These and other features may be best understood from the following drawings and specification.

DETAILED DESCRIPTION

Figure 1:
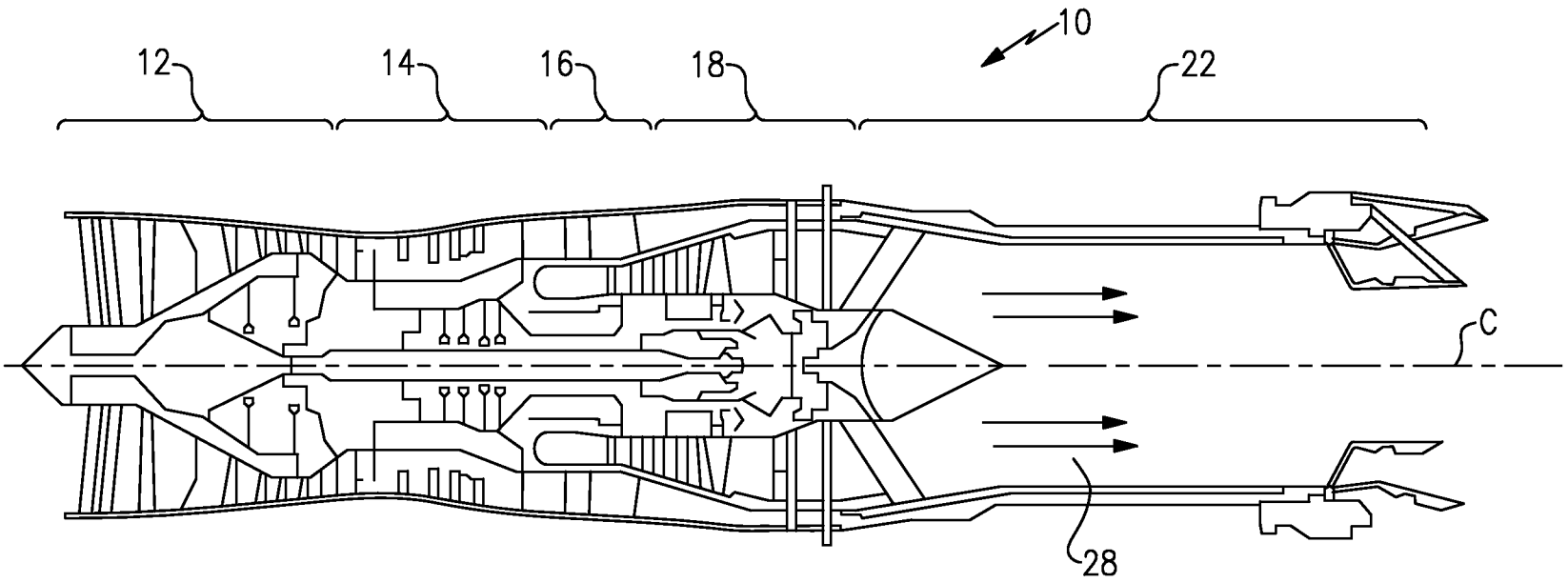
FIG. 1 is a schematic view of a gas turbine engine.

Referring to FIG. 1, a gas turbine engine 10 includes a fan section 12, a compressor section 14, a combustor section 16, and a turbine section 18. Air entering into the fan section 12 is initially compressed and fed to the compressor section 14. In the compressor section 14, the incoming air from the fan section 12 is further compressed and communicated to the combustor section 16. In the combustor section 16, the compressed air is mixed with gas and ignited to generate a hot exhaust stream 28. The hot exhaust stream 28 is expanded through the turbine section 18 to drive the fan section 12 and the compressor section 14. The exhaust gasses 28 flow from the turbine section 18 through an exhaust liner assembly 22.

Figure 2:
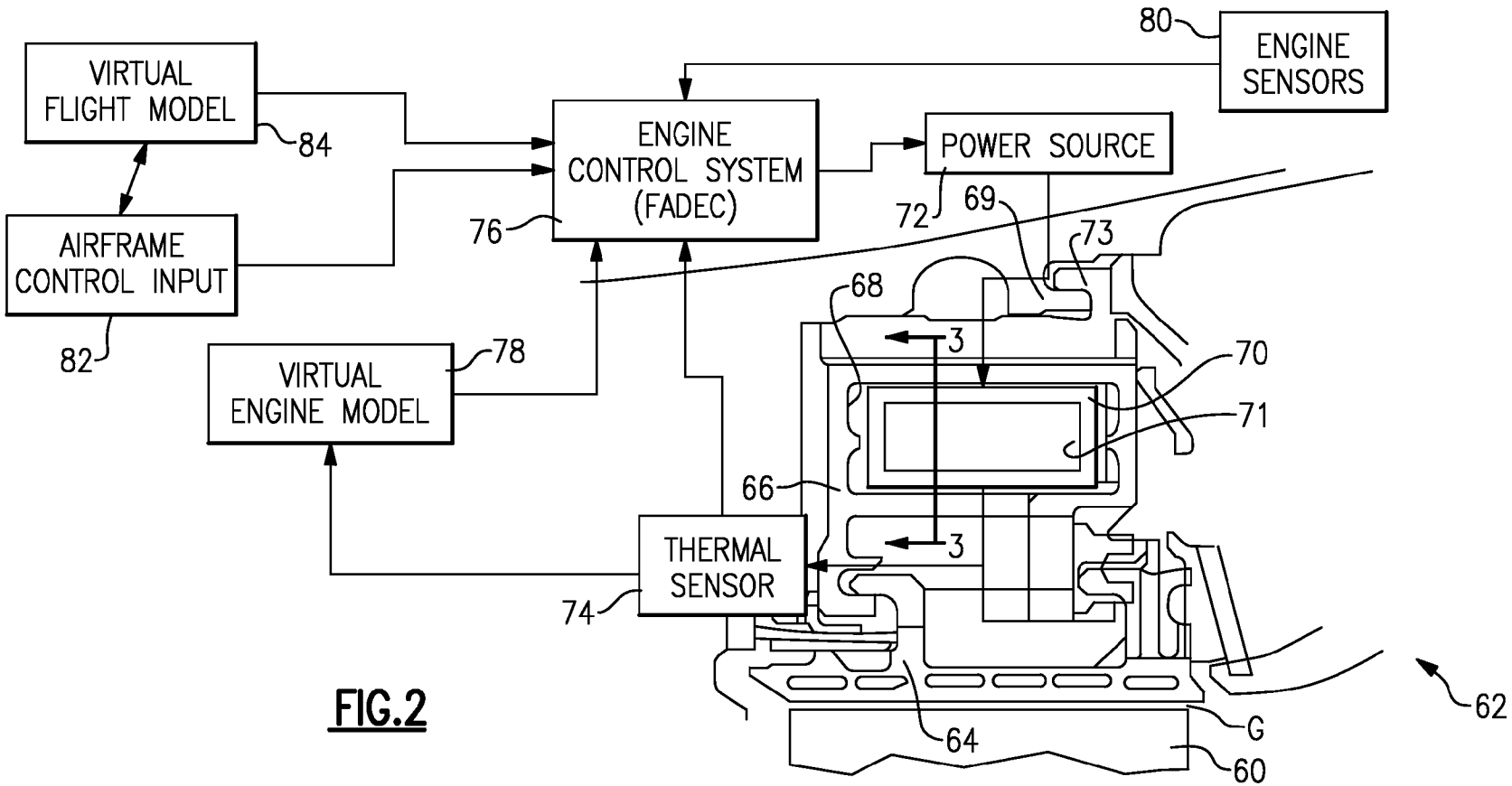
FIG. 2 is a detailed view of a blade outer air seal.

FIG. 2 shows a blade outer air seal assembly 62 for maintaining a gap G away from a radially outer tip of a rotating turbine blade 60. This can be part of a turbine section such as section 18 of FIG. 1.

However, the blade outer air seal assembly 62 may be used in other type engines and in the compressor section.

The blade outer air seal 64 is mounted to a carrier 66. In fact, there are a plurality of circumferentially spaced carrier portions 66, as will be explained below. The carrier portions 66 have a cavity 68 that receives a control ring 70. The control ring 70 provides a mount structure for the carrier portions 66, which are also mounted within a housing 69 at a hook 73. However, the control ring 70 provides structural support to maintain the carrier portions 66, as will be explained below. The control ring 70 is shown having an electric heater 71, which may be any known type of electric heater.

A power source 72 selectively provides power to the heater 71. The power source 72 is controlled by an engine control system 76, which may be a full authority digital engine controller, a digital electronic sequencing unit, an electronic sequencing unit, or any other engine controller.

The engine control system 76 receives a virtual engine model 78, along with information from a thermal sensor 74 which senses the temperature of the control ring 70. Further, engine sensors 80 provide information to the engine control system 76. The engine control system 76 also receives information from an airframe control input 82 and a virtual flight model 84. All of the information provided to the engine control system 76 is utilized to predict what a gap G is likely to be based on the given set of circumstances, and to determine whether it would be prudent to actuate the heater 71 in order to adjust the gap G.

The virtual flight model 84 predicts aircraft and engine loads based upon a current altitude, attitude, speed, outside air condition (temperature, pressure, humidity, etc.) and the aircraft configuration (fuel load, weapons, flaps, landing gear, etc.). Further, the magnitude and rate of control input are also evaluated. All of these are utilized to predict a magnitude of a tip closure change, or change in the size of gap G. The engine model 78 utilizes this information to provide a signal to control the heater 71.

Figure 3A:
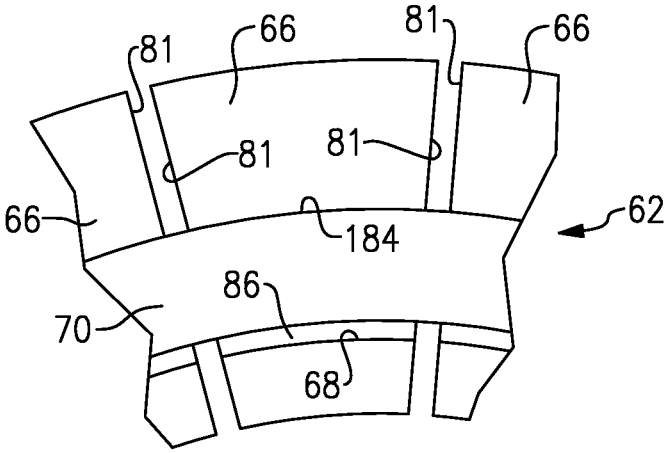
FIG. 3A shows a blade outer air seal assembly in a first condition and is taken along line 3-3 of FIG. 2.

As shown in FIG. 3A, the blade outer air seal assembly 62 is provided with a plurality of carrier portions 66, each having the cavity 68. The control ring 70 mounts the plurality of circumferentially spaced carrier portions 66. As shown, there are gaps between circumferential edges 81 of the carrier portion 66. In the position shown in FIG. 3A, the engine is not under an extreme load and is not unduly hot. Thus, the carrier portions 66 sit on a radially outer face 184 of the control ring 70 and there is a relatively large gap 86 at the radially inner face of the control ring 70.

Figure 3B:
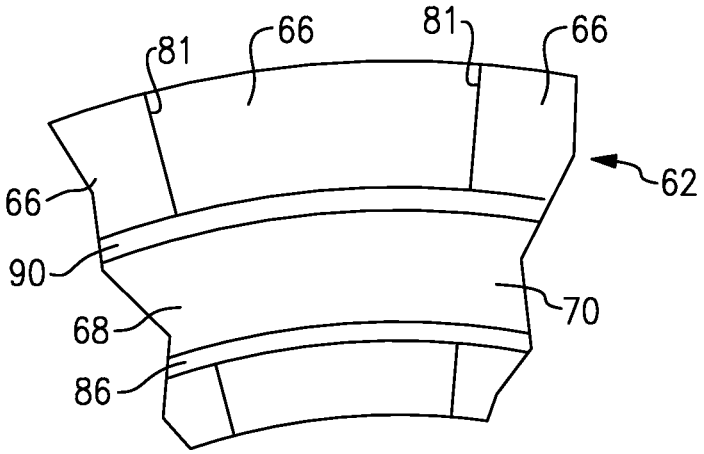
FIG. 3B shows the blade outer air seal assembly in a second condition and is taken along line 3-3 of FIG. 2.

The passive blade outer air seal assembly 62 operates, such as shown in FIG. 3B when the engine does become hot. As an example, when the engine accelerates then the carrier portions 66 expand radially outwardly much more quickly than does the control ring 70. This will cause the carrier portions 66 to expand both radially outwardly and such that there is a gap 90 at the radially outer face, along with a smaller gap 86 at the radially inner face. The carrier portions 66 also expand circumferentially such that the circumferential edges 81 contact, and lock together effectively forming a single carrier ring. Combined with radially outer expansion, this results in the gap 90.

The provision of the heater 71 allows the blade outer air seal assembly 62 to control the movement between the two positions shown in FIGS. 3A and 3B. In the position shown in FIG. 3A, there is a greater likelihood of rubbing between the blades 60 and the seal 64.

As the engine cools, the carrier portions 66 in the FIG. 3B position will tend to move back toward the FIG. 3A position. This may be undesirable if the engine is under extreme conditions. As an example, in aggressive maneuvering during a combat mission it may be desirable to maintain the carrier portions 66 in the FIG. 3B position even while the engine is cooling. Under such circumstances, then the heater 71 will be actuated to maintain the carrier portions 66 in the FIG. 3B position and minimize the likelihood of rubbing between the blade 60 and the seal 64.

On the other hand, should the engine be at a state of operation which is less aggressive, such as routine flight returning to a ship, as an example, then the FIG. 3A position may be favored and the heater 71 maintained off.

Other times when the FIG. 3B position may be preferred even when the engine is not otherwise hot, would be when a landing impact load may be expected, such as for aircraft carrier operation.

The blade outer air seal assembly 62 has a control ring 70 extending circumferentially about a central axis C (see FIG. 1). A plurality of circumferentially spaced carrier portions 66 have a cavity 68 receiving the control ring 70. There are circumferential gaps between the carrier portions 66. A blade outer air seal 64 is mounted on the carrier portions 66 radially inwardly of the control ring 70. The control ring 70 is provided with a heater 71, such that the control ring 70 can transmit heat to the carrier portions 66 to maintain the carrier portions 66 at a radially outwardly spaced position.

While the cavity 68 is shown as completely enclosed, and supported on the control ring, it should be understood that the term "cavity" as utilized in this application could extend to something that would simply be hooked over the control ring 70, but could be open, such as at radially outer location, as an example. Further, while the electric heater 71 is shown incorporated into the control ring, other mount locations may come within the scope of this invention, provided it still performs the function as set forth above.

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A blade outer air seal assembly comprising:

a control ring extending circumferentially about a central axis;

a plurality of circumferentially spaced carrier portions having a cavity receiving said control ring, the carrier portions positioned with circumferential gaps between said carrier portions;

a blade outer air seal mounted on said carrier portions radially inwardly of said control ring;

wherein said control ring maintains said carrier portions at a radially outwardly expanded position when said control ring is heated by an electric heater; and wherein when said carrier portions are at said radially outwardly expanded position, said carrier portions are spaced radially away from a radially outer surface of said control ring, and said carrier portions being movable to a radially inward position, wherein said carrier portions are in contact with said radially outer surface of said control ring.

2. The blade outer air seal assembly as set forth in claim 1, wherein power is selectively provided to said heater responsive to a control signal.

3. The blade outer air seal assembly as set forth in claim 2, wherein said control signal is provided by an engine control system.

4. The blade outer air seal assembly as set forth in claim 2, wherein said control signal is provided responsive to receiving a temperature of the control ring.

5. The blade outer air seal assembly as set forth in claim 2, wherein said control signal is provided with feedback from the engine by engine sensors.

6. The blade outer air seal assembly as set forth in claim 2, wherein said control signal is provided responsive to a virtual flight model.

7. The blade outer air seal assembly as set forth in claim 2, wherein said electric heater is part of said control ring.

8. The blade outer air seal as set forth in claim 1, wherein said blade outer seal is installed in a turbine section.

9. The blade outer air seal assembly as set forth in claim 1, wherein circumferential edges of said carrier portions are spaced from each other when in said radially inward position, and in contact with each other at said radially outwardly expanded position.

10. A gas turbine engine comprising:

a turbine section having a plurality of rotating turbine blades, and a blade outer air seal mounted radially outwardly of said turbine section and there being a tip clearance between a radially outer portion of said blades and a radially inner face of said blade outer air seal;

a control ring extending circumferentially about a central axis;

a plurality of circumferentially spaced carrier portions having a cavity receiving said control ring, the carrier portions positioned with circumferential gaps between said carrier portions, said blade outer air seal mounted on said carrier portions radially inwardly of said control ring, wherein said control ring maintains said carrier portions at a radially outwardly expanded position when said control ring is heated by an electric heater; and wherein when said carrier portions are at said radially outwardly expanded position, said carrier portions are spaced radially away from a radially outer surface of said control ring, and said carrier portions being movable to a radially inward position, wherein said carrier portions are in contact with said radially outer surface of said control ring.

11. The gas turbine engine as set forth in claim 10, wherein power is selectively provided to said heater responsive to a control signal.

12. The gas turbine engine as set forth in claim 11, wherein said control signal is provided by an engine control system.

13. The gas turbine engine as set forth in claim 12, wherein said control signal is provided responsive to receiving a temperature of the control ring.

14. The gas turbine engine as set forth in claim 11, wherein said control signal is provided with feedback from the engine by engine sensors.

15. The gas turbine engine as set forth in claim 11, wherein said control signal is provided responsive to a virtual flight model.

16. The gas turbine engine as set forth in claim 11, wherein said control signal is provided responsive to receiving a temperature of the control ring.

17. The gas turbine engine as set forth in claim 10, wherein circumferential edges of said carrier portions are spaced from each other when in said radially inward position, and in contact with each other at said radially outwardly expanded position.

* * * * *